United States Patent [19]

Cebulak

[11] 4,135,922

[45] Jan. 23, 1979

[54] METAL ARTICLE AND POWDER ALLOY AND METHOD FOR PRODUCING METAL ARTICLE FROM ALUMINUM BASE POWDER ALLOY CONTAINING SILICON AND MANGANESE

[75] Inventor: Walter S. Cebulak, New Kensington, Pa.

[73] Assignee: Aluminum Company of America, Pittsburgh, Pa.

[21] Appl. No.: 751,731

[22] Filed: Dec. 17, 1976

[51] Int. Cl.[2] ..... C22C 21/02

[52] U.S. Cl. ..... 75/143; 29/420; 29/420.5; 75/0.5 C; 75/148; 75/249; 75/950; 148/11.5 P; 148/32

[58] Field of Search ..... 75/148, 143, 0.5 C, 75/249, 950; 148/11.5 P, 32; 29/420, 420.5

[56] References Cited

U.S. PATENT DOCUMENTS 3,544,392 12/1970 Lyle et al. ..... 148/11.5 P

*Primary Examiner*—R. Dean

*Attorney, Agent, or Firm*—Patrick J. Viccaro

[57] ABSTRACT

A method is provided for producing a metal article from an Al-Si-Mn powder alloy. The alloy is produced by alloying elements in a molten state and a powder of the alloy is produced by atomization. Powder is heated, worked into a finished article of at least 99% density.

A metal article produced has a coefficient of thermal expansion less than $11.0 \times 10^{-6}$ inch/inch/° F and relatively high strength at temperatures greater than 400° F (478° K). Article produced is ideally suited for uses, such as piston, requiring limited thermal expansion while maintaining high temperature strength.

An aluminum base powder alloy provided consists essentially of 10 to 25%, Si, 2 to 5% Mn, the balance essentially aluminum and incidental elements and impurities, and is substantially free of Mg, Zn and Ni. Additive elements may be Fe or Cu and Cr, V Zr and Ti. The powder alloy can be atomized in a temperature range of 1400 to 1600° F (1033 to 1144° K).

22 Claims, No Drawings

METAL ARTICLE AND POWDER ALLOY AND METHOD FOR PRODUCING METAL ARTICLE FROM ALUMINUM BASE POWDER ALLOY CONTAINING SILICON AND MANGANESE

BACKGROUND OF THE INVENTION

This invention relates to an aluminum base powder alloy and metal articles made therefrom and a method of making metal articles. More particularly, it relates to an aluminum base powder alloy, containing silicon and manganese, produced at a relatively low alloy atomizing temperature and to a method of producing metal articles such that an article made therefrom has a relatively low coefficient of thermal expansion and high strength at elevated temperatures.

Aluminum and aluminum base alloys have certain characteristic advantages over other metals and metal alloys; one such advantage is their light weight. With the weight of materials becoming increasingly important, as for example, the concern to decrease the weight of motor vehicles, such concern has resulted in the increasing use of aluminum. Aluminum base alloys can be suitable for use in pistons for internal combustion engines and with such use are subjected to severe working conditions.

The pistons and the engine block may be subjected to different thermal conditions, and thus different expansion rates, since the engine block temperature may be lower than the piston temperature as a result of a coolant circulating through the engine block. Such is the case whether or not the piston and block are made of the same metal alloys, as steel, cast iron, or aluminum. The problem is accentuated, however, when the piston and block are of dissimilar metals. The piston which may be the hottest portion of the engine should have thermal expansion properties which will enable it to maintain its dimensional stability relative to the engine block over a temperature range higher than the engine block. The strength of the material should also be maintained over such higher temperatures. It is especially desirable, therefore, that such aluminum base alloys have a relatively low coefficient of thermal expansion and be able to maintain a relatively high strength at elevated temperatures for an extended period of time.

Aluminum base alloys containing relatively large amounts of silicon and manganese have been used in cast articles. U.S. Pat. No. 1,829,668, issued Oct. 27, 1931, discloses a cast aluminum base alloy containing 4 to 13% silicon and 4 to 13% manganese. Cast pistons made from aluminum base alloys containing silicon and manganese are also disclosed in the prior art. U.S. Pat. No. 2,185,348, issued Jan. 2, 1940, relates to an aluminum base alloy containing up to 13% silicon, up to 3% manganese, and significant amounts of iron, antimony and a metal from a tungsten group. U.S. Pat. No. 2,357,451, issued Sept. 5, 1944, discloses an aluminum base alloy having 18 to 35% silicon, up to 1% manganese, up to 1% magnesium, and significant amounts of copper, iron, tin and zinc.

It is also recognized in the art to use powder metallurgy (P/M) techniques in high strength dispersion-hardened alloys with elements that normally cannot be cast in aluminum without difficulty. Aluminum base alloy powder containing significant amounts of magnesium, silicon and manganese is disclosed in U.S. Pat. No. 2,287,251, issued June 23, 1942. Using a powder form of aluminum base alloys containing significant amounts of silicon for making pistons is disclosed in U.S. Pat. No. 2,978,798, issued Apr. 11, 1961 and U.S. Pat. No. 3,282,745, issued Nov. 1, 1966. Such alloys for making powder should have a low liquidus temperature, i.e. low melting point of the alloy, to simplify the production of powder by using less expensive and less complex equipment. Typically, a suitable molten alloy can be atomized at a temperature higher than the liquidus temperature of the alloy. Such a higher temperature is used to ensure successful atomization with many aluminum alloys being atomized in excess of 1625° F. (1158° K.). In practice, there is some cooling of the molten metal during atomization due to an atomizing gas temperature which is usually lower than the liquidus temperature. When that is the case, then a metal atomizing temperature greater than the liquidus temperature is used. An atomizing temperature of about 1650° F. (1172° K.) or more, however, becomes impractical from a cost standpoint.

The aluminum base powders of the prior art do not provide the characteristics and properties desired in metal articles that undergo the stresses and temperatures such as may be prevalent with automotive pistons and the like. For instance, it is desirable to provide an alloy which can take the advantages of powder metallurgy techniques and can offer relatively high strength at temperatures above 400° F. (478° K.) and a low thermal expansion coefficient of less than $11.0 \times 10^{-6}$ inch/inch/° F. over a range of 0 to 250° F. (255 to 394° K.) and can be melted and atomized at a temperature as low as about 1400° F. (1033° K.) to a relatively fine powder.

SUMMARY OF THE INVENTION

In accordance with the present invention, a method is provided for producing a metal article from an aluminum base powder alloy containing silicon and manganese having the desired characteristics. The aluminum alloy consists essentially of 10 to 25% silicon, 2 to 5% manganese, the balance essentially aluminum and incidental elements and impurities, and is substantially free of magnesium, zinc and nickel. The powder alloy may also contain up to 1.5% Fe or 2 to 5% Cu and up to 0.4% each of one or more elements from the group consisting of Cr, V, Zr and Ti. All elements and compositions referred to herein are in weight percent. The aluminum base powder alloy is made by alloying elements in a molten state and then producing a fine aluminum alloy powder by atomizing at temperatures from as low as about 1400 to 1600° F. (1033° K. to 1144° K.). A metal article is made from heated powder alloy which is worked, preferably forged in one operation, to produce an article characterized by a thermal coefficient of expansion less than $11.0 \times 10^{-6}$ inch/inch/° F. and relatively high strength at elevated temperatures greater than 400° F. (478° K.). The article can then be subsequently machined to its final shape. Thus is provided an aluminum base powder alloy ideally suited for use in metal articles which may be subject to such extreme conditions as may be encountered by automotive piston applications.

DETAILED DESCRIPTION OF THE PREFERRED EMBODIMENTS OF THE INVENTION

Generally, the aluminum powder of the present invention is an Al-Si-Mn alloy. The aluminum base powder alloy contains silicon in a range of 10 to 25%, preferably, 13 to 20%. The silicon in the powder alloy contributes to its hardness and also helps decrease the coefficient of thermal expansion. The manganese present in the aluminum base powder also contributes to the hardness. The range of manganese is 2 to 5%, preferably 3 to 4.5%.

Each of the elements in the group consisting of Cr, V, Zr and Ti may be present in amounts up to 0.4%, for instance 0.05 to 0.4%. Preferably, these elements may be about 0.2%. It is believed that the presence of these elements improves the overall ductility without appreciably affecting the overall strength and thermal expansion of the powder alloy and metal articles made therefrom in accordance with the method of the present invention, especially when the powder is preheated at higher temperatures prior to consolidation. It is further believed that while these elements are not essential to the overall strength of the composition, their presence does facilitate stability of the higher strength at elevated temperatures.

The alloy may contain as an additive alloying constituent the element Fe or Cu. Fe may be present in amounts up to 1.5%, for instance 0.25 to 1.5% with a preferred maximum for Fe being 0.5%. Cu may be present in amounts of 2 to 5%. The addition of either Fe or Cu is believed to contribute to the overall strength of the composition. While Fe is believed to give added strength to the composition, it also deleteriously effects the atomizing temperature which means that the atomizing temperature increases with excessively increasing Fe. Increasing amounts of Mn similarly affects the atomizing temperature. Therefore, when Fe additive is present in the composition, the overall effect of the Fe and Mn on the atomizing temperature should be controlled. When Fe is present in amounts of 0.25 to 1.5%, then the presence of Mn is limited to amounts of 2 to 4%.

The presence of Cu is believed to contribute to the overall strength without affecting the atomizing temperature. Cu may be present in amounts of 2 to 5% for a range of 2 to 5% Mn. Furthermore Cu is believed to provide improved strength at lower temperatures than does the addition of Fe.

The alloy composition of the present invention is substantially free of magnesium, zinc and nickel, which means no more than 1% Mg, 1% Zn and 1% Ni can be tolerated, with a total amount of magnesium, zinc and nickel of 2% or less. It is believed that the presence of these elements will not appreciably affect the desired properties and characteristics of the aluminum base powder alloy as long as their weight percent is maintained below the above-mentioned amounts. There may be some degradation of strength at elevated temperatures if the amounts each of Mg and Zn are allowed to exceed 1%. The presence of Ni, however, may contribute to the overall strength of the composition if it is present in combination with the aforesaid amounts of Fe. Ni also can adversely effect the atomization temperature of the composition in a similar manner as does excessive amounts of Fe or Mn. The presence of Ni must for that reason be limited to a maximum of 1%.

The balance of the composition contains essentially aluminum and incidental elements and impurities.

The powder of the aluminum base alloy composition of the present invention is produced by atomization of a homogeneous alloy in molten state. Preferably, the atomizing is done with air, but it is believed that atomizing in other gases or the inert gases will also work. The powder alloy of the present invention atomized in air will exhibit some oxide impurities or oxygen in some reacted form as a result of the atomization. Oxygen in amounts of 0.2 to 0.4%, by weight, may be present in oxides with corresponding oxide levels of about 0.4 to about 0.8% in the powder composition. It is not known what oxides are present, but amounts of oxides at such low levels are believed to be innocuous to the overall properties of the composition.

The atomized fine powder particles may have any shape, such as irregular or spheroid in practicing the present invention. The fine powder average particle diameter (A.P.D.) as determined by the Fisher subsieve sizer is preferably less than 20 microns. A.P.D. refers to a satistical diameter of the powder particles and is measured by the Fisher subsieve sizer by determining the flow rate of a gas through a powder bed under a controlled pressure differential.

In the method of making the aluminum base powder alloy of the present invention and a metal article made thereof, the elements of the alloy are alloyed in a molten state. The metal atomization temperature may range from as low as about 1400 to 1600° F. (1033 to 1144° K.), preferably 1420 to 1550° F. (1044 to 1116° K.). The capability to melt the alloy and atomize below 1600° F. (1144° K.) to as low as about 1400° F. (1033° K.) significantly reduces powder cost by simplifying the melting necessary for forming the powder. The low atomization temperature thus enables the present invention to be practiced with less complex atomizing equipment to produce a powder.

The atomized powder may then be placed in a container to facilitate handling and transporting the powder to the compacting equipment, such as forging dies. The amount of powder used may be in excess of that needed to provide an article of a predetermined density. In accordance with the present invention, no lubricants need be added to the powder. Generally in the prior art, lubricants in a dry or slurry form are added to facilitate consolidation of the powder in an effort to eliminate and to protect against friction between the powder and the tool parts effecting consolidation. The elimination of the need to add lubricants to the powder of the present invention is a distinct advantage. It is desirable, however, to lubricate the compacting tools, as in the prior art, to reduce friction between the powder and tool parts.

Prior to compacting a metal powder alloy, binders, such as resinous binders, have been added to powder in the prior art to hold powder particles together. The present invention can be practiced without the use of binders, if desired, and as such, is advantageous over much prior art.

The powder is confined and preheated prior to consolidation to a substantially uniform temperature to facilitate bonding of the powder during conditions of plastic deformation. Such temperatures should be below the solidus temperature of the alloy such that no incipient melting occurs. By incipient melting it is meant that no initial condition of melting is present. The temperature should be at least 500° F. (533° K.) and may range, preferably, from 650 to 1050° F. (616 to 839° K.). The preheating atmosphere may be air, a vacuum, nitrogen, or any other suitable atmosphere. The powder may be preheated in a container while loose, i.e., not more than lightly tamped into the container, or it may be preheated after the loose powder has been pressed to a sufficient density for handling as a compact. The dies, such as forging dies, may be used to preheat the powder placed therein. Preferably, the powder is preheated outside the consolidation equipment.

The powder can be consolidated through intermediate compacting steps or, preferably, as a one step operation to the finished worked product of a predetermined density approaching 100%, and at least 99%. If done in one step, the powder must be kept above a minimum temperature of at least 500° F. (533° K.), required to facilitate bonding and plastic deformation of the powder. The powder may be compacted to intermediate shapes and densities, with alternating intermediate heating steps before the predetermined density of at least 99% of the finished worked product is achieved.

As a one step operation, the consolidation of the powder is done, preferably, by forging in closed dies. The closed dies may be provided with relief for flash to permit escape of excess metal during the forging step. It is believed that the powder also can be consolidated and worked (plastically deformed) by extruding within the scope of this invention. Powder consolidation is done at an elevated temperature sufficient to facilitate bonding whether the consolidation is a one or more step operation. Such hot working of the powder can be further aided by providing heated tools.

An advantage of the present invention is that no sintering of the powder alloy in a separate operation is needed to achieve a metal article having the desired characteristics. Thus, the method of the present invention can be practiced without sintering and, thus, is less complicated than prior art methods requiring sintering.

An article made from the aluminum base powder alloy of the present invention has a coefficient of thermal expansion of less than $11.0 \times 10^{-6}$ inch/inch/° F. over a range of 0 to 250° F. (255 to 394° K.) and relatively high strength at temperatures greater than 400° F. (478° K.) and a density of greater than 99%. The article may be subsequently machined into its final shape. No post heat treatment is normally needed. Subsequent heat treatment might raise the ductility of the final product but would also probably lower the overall strength. Thus, the metal article of the present invention has as an advantage the capability of being used in the as-worked condition without the need for further treatment. If a deformable container is used to confine the powder during compacting, such as in the one step hot forge operation, the container may be subsequently removed from the formed article. The container may also be part of the finished worked product and therefore, no removal operation is necessary.

In order to more completely understand the present invention, the following example is presented:

EXAMPLE

The alloys of the present invention shown in the following Tables I and II are made by alloying the elements in a molten state and then atomizing the alloy to a relatively fine powder size (A.P.D. less than 20 microns). The alloys in Groups I and II are atomized at a metal temperature of about 1420 to 1450° F. (1044 to 1061° K.). The atomizing gas is air at a temperature of about 1100° F. (866° K.). Two groups of powder alloys of the present invention are then loaded into aluminum containers 6 inch O.D. × 5.5 inch I.D. × 4 or 7 inch high inside and preheated substantially uniformly to a temperature of 700° F. (644° K.) for Group I and 1000° F. (811° K.) for Group II. The preheating is done in an atmosphere of flowing nitrogen ($N_2$). Each individual container is then hot pressed/forged in one operation at 75 ksi in heated tools to a heavy wall cup-shaped section 5.6 inch high with 1.25 inch thick cup walls, and 3 inch deep cup cavity. Samples are tested in the as-forged condition, i.e. no further heat treatment after forging.

TABLE I

Properties of P/M Forged Alloys at 600° F (589° K) After 100 Hours' Exposure at 600° F (589° K) Versus Comparison Alloys Tested at 600° F (589°at K)

| Alloy(1) | TS (ksi) | YS (.2% Offset) (ksi) | % El. in 4D | Thermal Expansion Coef. (2) (in./in./° F) |
|---|---|---|---|---|
| Group I Preheated at 700° F (644° K) | | | | |
| Al-20Si-4.5Mn | 24.4 | 23.4 | (3) | $10.1 \times 10^{-6}$ |
| Al-20Si-3Mn-0.4Fe | 21.9 | (4) | — | — |
| Al-20Si-4Cu-3.4Mn | 23.9 | 21.8 | 1.5 | $9.6 \times 10^{-6}$ |
| Al-13Si-3Mn-1Fe | 24.1 | 21.2 | 1.0 | $10.5 \times 10^{-6}$ |
| Group II Preheated at 1000° F (811° K) | | | | |
| Al-20Si-4.5Mn | 20.6 | 17.0 | 6.0 | $8.8 \times 10^{-6}$ |
| Al-20Si-3Mn-0.4Fe | 17.4 | 14.6 | 15.0 | $10.3 \times 10^{-6}$ |
| Al-20Si-4Cu-3.4Mn | 18.4 | 15.7 | 7.0 | $10.2 \times 10^{-6}$ |
| Al-13Si-3Mn-1Fe | 15.8 | 13.4 | 15.0 | $11.0 \times 10^{-6}$ |
| Comparison Alloys | | | | |
| Cast Alloy A(6) | 10.0 | 4.0 | 10.0 | $11.0 \times 10^{-6}$ |
| P/M Alloy B(7) | 21.0 | 13.6 | 8.0 | $10.2 \times 10^{-6}$(5) |
| 6061-T6 | 4.6 | 2.7 | 85.0 | $12.9 \times 10^{-6}$(8) |

NOTES FOR TABLE I:
(1)For Group I and II alloys, plus 0.2% each Cr, V, Zr and Ti
(2)68 to 212° F (293 to 373° K)
(3)Failed in Threads - Not Determined
(4)Failed Before 0.2% Offset
(5)68 to 572° F (293 to 573° K)
(6)Al-12Si-1.0Cu-1.0Mg-2.5Ni, in T551 Temper
(7)Al-20Si-5Fe-0.2% each Cr, V, Zr and Ti [1000 hours' exposure at 600° F (589° K)]
(8)70 to 200° F (294 to 366° K)

TABLE II

Properties of P/M Forged Alloys at 400° F (478° K) After 100 Hours' Exposure at 400° F (478° K) Versus Comparison Alloys Tested at 400° F (478° K)

| Alloy(1) | TS (ksi) | YS (.2% Offset (ksi) | % El. in 4D | Thermal Expansion Coef.(29/ (in./in./° F) |
|---|---|---|---|---|
| Group I Preheated at 700° F (644° K) | | | | |
| Al-20Si-4.5Mn | 43.8 | 40.0 | 1.0 | $10.1 \times 10^{-6}$ |
| Al-20Si-3Mn-0.4Fe | 28.0 | (3) | — | — |
| Al-20Si-4Cu-3.4Mn | 44.0 | 38.7 | 1.0 | $9.6 \times 10^{-6}$ |
| Al-20Si-3Mn-09.4Fe | 28.0 | (3) | — | — |
| Al-20Si-4Cu-3.4Mn | 44.0 | 38.7 | 1.0 | $9.6 \times 10^{-6}$ |
| Al-13Si-3Mn-1Fe | 38.1 | 34.0 | 3.0 | $10.5 \times 10^{-6}$ |
| Group II Preheated at 1000° F (811° K) | | | | |
| Al-20Si-4.5Mn | 29.6 | 25.2 | 5.0 | $8.8 \times 10^{-6}$ |
| Al-20Si-3Mn-0.4Fe | 25.8 | 20.6 | 10.5 | $10.3 \times 10^{-6}$ |
| Al-20Si-4-Cu-3.4Mn | 29.9 | 22.7 | 5.0 | $10.2 \times 10^{-6}$ |
| Al-13Si-3Mn-1Fe | 22.3 | 18.9 | 15.0 | $11.0 \times 10^{-6}$ |
| Comparison Alloys | | | | |
| Cast Alloy A(5) | 26.0 | 15.0 | 2.0 | $11.0 \times 10^{-6}$ |
| P/M Alloy B(6) | 32.4 | 24.5 | 5.5 | $10.2 \times 10^{-6}$ |
| 6061-T6 | 19.0 | 15.0 | 28.0 | $12.9 \times 10^{-6}$(7) |

NOTES FOR TABLE II:
(1)For Group I and II alloys, plus 0.2% each Cr, V, Zr and Ti
(2)68 to 212° F (293 to 373° K)
(3)Failed Before 0.2% Offset
(4)68 to 572° F (293 to 573° K)
(5)Al-12Si-1.0Cu-1.0Mg-2.5Ni, in T5541 Temper
(6)Al-20Si-5Fe-0.2% each Cr, V, Zr and Ti [1000 hours' exposure at 400° F (478° K)]
(7)70 to 200° F (294 to 366° K)

Tables I and II demonostrate the outstanding combinations of high strength at elevated temperatures and low thermal coefficient of expansion of articles made from the aluminum base powder alloy of the present invention. Mechanical property comparisons at 600° F. (589° K.) after 100 hours' exposure time at 600° F. (589°

K.), and 400° F. (478° K.) after 100 hours' exposure time at 400° F. (478° K.) for these alloys are made. Note that all of the alloys of the present invention offer superior strength at both temperatures and a coefficient of thermal expansion lower than cast Alloy A which is often used for casting automotive pistons. In addition, the alloys are generally stronger than Alloy B which is made by powder metallurgy techniques and which has an atomizing temperature greater than 1600° F. (1144° K.). The composition of Alloy B is similar to the compositions of the present invention except for the absence of significant amounts of Mn and for the presence of excessive Fe in Alloy B. Tabulated data of some mechanical properties of a standard wrought alloy 6061-T6 provide a baseline for property comparisons.

TABLE III

Effect of Minor Element Additions on 600° F (589° K) Tensile Properties of P/M Forged Al-20Si-4.5Mn Alloys

| Alloy | Other Alloying Additions Cr | Ti | V | Zr | Tensile Properties TS (ksi) | YS (ksi) | % El. in 4D | % R.A. |
|---|---|---|---|---|---|---|---|---|
| Preheated at 700° F (644° K) | | | | | | | | |
| C | — | — | — | — | 25.0 | 20.2 | 2.0 | 1 |
| D | 0.2 | 0.2 | — | — | 25.0 | 22.8 | (1) | — |
| E | 0.2 | 0.2 | 0.2 | 0.2 | 24.4 | 23.4 | (1) | — |
| Preheated at 1000° F (811° K) | | | | | | | | |
| C | — | — | — | — | 21.8 | 19.1 | 3.0 | 3 |
| D | 0.2 | 0.2 | — | — | 22.4 | 18.6 | 6.5 | 8 |
| E | 0.2 | 0.2 | 0.2 | 0.2 | 20.6 | 17.0 | 6.0 | 6 |

NOTES:
(1)Failed in Threads

TABLE IV

Effect of Minor Element Additions on 400° F (478° K) Tensile Properties of P/M Forged Al-20Si-4.5Mn Alloys

| Alloy | Other Alloying Additions Cr | Ti | V | Zr | Tensile Properties TS (ksi) | YS (ksi) | % El. in 4D | % R.A. |
|---|---|---|---|---|---|---|---|---|
| Preheated at 700° F (644° K) | | | | | | | | |
| C | — | — | — | — | 38.7 | 35.3 | 1.0 | 1 |
| D | 0.2 | 0.2 | — | — | 38.6 | (1) | — | — |
| E | 0.2 | 0.2 | 0.2 | 0.2 | 43.8 | 40.0 | 0.5 | — |
| Preheated at 1000° F (811° K) | | | | | | | | |
| C | — | — | — | — | 28.4 | 24.2 | 6.0 | 7 |
| D | 0.2 | 0.2 | — | — | 30.2 | 25.6 | 6.5 | 8 |
| E | 0.2 | 0.2 | 0.2 | 0.2 | 29.6 | 25.2 | 5.0 | 6 |

NOTES:
(1)Failed before 0.2% Offset

Tables III and IV illustrate the effect of the additions of elements Cr, V, Zr and Ti on the composition of the present invention, for example, those containing 20% Si and 4.5% Mn. The minor elements appear to have a relatively small effect on strength at 600° F. (589° K.) after 100 hours' exposure and at 400° F. (478° K.) after 100 hours' exposure. The minor elements may result in better ductility, notably for materials preheated at higher temperatures. The atomization temperature for Alloys C, D and E is from about 1420 to 1500° F. (1044 to 1089° K.).

Although embodiments and alternative embodiments have been described, it will be apparent to those skilled in the art that changes can be made therein without departing from the scope of the invention.

What is claimed is:

1. A method for producing an aluminum base article comprises:

alloying elements in a molten state to produce an alloy consisting essentially of the elements 10 to 25% Si, 2 to 5% Mn, and substantially free of Mg, Zn and Ni, the balance essentially aluminum and incidental elements and impurities;

producing a powder from said alloy in a molten state by atomization at temperatures from as low as 1400 to 1600° F.;

heating said powder to a substantially uniform temperature sufficient to facilitate metallurgical bonding during conditions of plastic deformation; and working said powder in dies into a finished worked shape of said article requiring no further plastic deformation and having a density of at least 99%, said article characterized by a coefficient of thermal expansion less than $11.0 \times 10^{-6}$ inch/inch/° F. and relatively high strength at temperatures greater than 400° F.

2. The method set forth in claim 1 wherein said alloy further contains as an element, up to 1.5% Fe or 2 to 5% Cu.

3. The method set forth in claim 2 wherein when said alloy contains 0.25 to 1.5% Fe, said alloy contains 2 to 4% Mn.

4. The method set forth in claim 2 wherein when said alloy contains 2 to 5% Cu, said alloy contains 2 to 5% Mn.

5. The method set forth in claim 1 wherein said alloy further contains up to 0.4% each of one or more elements from the group consisting of Cr, V, Zr and Ti.

6. The method set forth in claim 1 wherein working said powder is performed by forging.

7. The method set forth in claim 6 wherein forging said powder is done in one compressive step.

8. The method set forth in claim 1 wherein said alloy contains 13 to 20% Si and 3 to 4.5% Mn.

9. A method for producing an article, having a coefficient of thermal expansion less than $11.0 \times 10^{-6}$ inch/inch/° F. and relatively high strength at elevated temperatures, from an aluminum base powder alloy, comprises:

melting and alloying elements to produce a homogeneous alloy consisting essentially of the elements 10 to 25% Si, 2 to 5% Mn and no more than 1% Mg, 1% Zn and 1% Ni, the total amount of Mg, Zn and Ni being no more than 2%, the balance essentially aluminum and incidental elements and impurities;

atomizing said alloy in a molten state to produce an aluminum base powder at a temperature of 1420 to 1550° F.;

placing in a deformable container an amount of loose powder needed to forge said article to a predetermined density;

heating said powder to a substantially uniform temperature of at least 500° F. to facilitate metallurgical bonding during conditions of plastic deformation; and forging said container and powder therein into a forged shape of said article having a predetermined density of at least 99%.

10. In a method of producing an article from an aluminum base powder alloy having the steps of melting and alloying elements to produce a homogeneous alloy, atomizing said alloy to produce a powder thereof, heating said powder to a substantially uniform temperature to facilitate metallurgical bonding during plastic deformation, working said powder in dies into a finished worked shape having a density of at least 99%, wherein the improvement comprises:

providing said alloy consisting essentially of 10 to 25% Si, 2 to 5% Mn and substantially free of Mg, Zn and Ni, the balance essentially aluminum and incidental elements and impurities;

atomizing said alloy at a temperature of 1400 to 1600° F. to produce a powder which is worked into an article having a coefficient of thermal expansion less than $11.0 \times 10^{-6}$ inch/inch/° F. and relatively high strength at temperatures greater than 400° F.

11. A metal article produced from a powder of an aluminum base alloy atomized at a temperature as low as 1400° F. and consisting essentially of 10 to 25% Si, 2 to 5% Mn and substantially free of Mg, Zn and Ni, the balance essentially aluminum and incidental elements and impurities, said powder being substantially uniformly heated to facilitate metallurgical bonding and being subjected to plastic deformation to produce said article having a predetermined density of at least 99%, a coefficient of thermal expansion less than $11.0 \times 10^{-6}$ inch/inch/° F. and relatively high strength at temperatures greater than 400° F.

12. The metal article as set forth in claim 11 wherein said powder aluminum base alloy further contains one element from the group consisting of up to 1.5% Fe and 2 to 5% Cu.

13. The metal article as set forth in claim 12 wherein said alloy contains 0.25 to 1.5% Fe and 2 to 4% Mn.

14. The metal article as set forth in claim 12 wherein said alloy contains 2 to 5% Cu and 2 to 5% Mn.

15. The metal article as set forth in claim 12 wherein said powder aluminum base alloy further contains up to 0.4% each of one or more elements from the group consisting of Cr, V, Zr and Ti.

16. The metal article as set forth in claim 11 wherein plastic deformation of said powder is done by forging.

17. The metal article as set forth in claim 16 wherein said forging is performed in one compressive step.

18. A metal article produced from a powder of an aluminum base alloy by heating said powder to a substantially uniform temperature and forging said powder to a predetermined density, said alloy consisting essentially of 10 to 25% Si, 2 to 5% Mn, up to 1.5% Fe or 2 to 5% Cu, and up to 0.4% each of one or more elements from the group consisting of Cr, V, Zr and Ti, and no more than 1% Mg, 1% Zn and 1% Ni, the total amount of Mg, Zn and Ni being no more than 2%, the balance essentially aluminum and incidental elements and impurities, said powder atomized at a metal temperature of 1420 to 1550° F., said article being characterized by a coefficient of thermal expansion of less than $11.0 \times 10^{-6}$ inch/inch/° F. and relatively high strength at temperatures of greater than 400° F.

19. An aluminum base powder alloy consisting essentially of the elements 10 to 25% Si, 2 to 5% Mn and substantially free of Mg, Zn and Ni, the balance essentially aluminum and incidental elements and impurities, said alloy being made by allowing said elements in a molten state and then atomizing said alloy at a temperature of 1400 to 1600° F. to produce a powder of said alloy, said powder when hot worked producing an aluminum alloy article characterized by a thermal coefficient of expansion of less than $11.0 \times 10^{-6}$ inch/inch/° F. and relatively high strength at temperatures of greater than 400° F.

20. The aluminum powder alloy as set forth in claim 19 further containing an additive alloying constituent of up to 1.5% Fe or 2 to 5% Cu.

21. The aluminum powder alloy as set forth in claim 19 further containing up to 0.4% of one or more elements from the group consisting of Cr, V, Zr and Ti.

22. Aluminum base powder alloy consisting essentially of the elements 10 to 25% Si, 2 to 5% Mn, an element selected from the group consisting of up to 1.5% Fe and 2 to 5% Cu and up to 0.4% each of one or more elements from the group consisting of Cr, V, Zr and Ti, and no more than 1% Mg, 1% Zn and 1% Ni, the total amount of Mg, Zn and Ni being no more than 2%, said alloy being made by alloying said elements in a molten state, and then producing a powder thereof, by atomization at a temperature of 1420 to 1550° F., which when hot worked produces an aluminum alloy article characterized by a coefficient of thermal expansion less than $11.0 \times 10^{-6}$ inch/inch/° F. and relatively high strength at temperatures greater than 400° F.

* * * * *

UNITED STATES PATENT AND TRADEMARK OFFICE

CERTIFICATE OF CORRECTION

PATENT NO. : 4,135,922

DATED : January 23, 1979

INVENTOR(S) : Walter S. Cebulak

It is certified that error appears in the above-identified patent and that said Letters Patent are hereby corrected as shown below:

Col. 6, Table II, under heading "Group I" delete entirely lines 4 and 5 which are repetitions of the two previous lines.

Col. 6, Table II, in the heading "Thermal Expansion Coef." change "(29/" to --(2)--.

Col. 6, Table II, for "Comparison Alloys" under the column headed "Thermal Expansion Coef.", line 2, after "$10.2 \times 10^{-6}$" insert --(4)--.

Col. 6, under "NOTES FOR TABLE II", in note (5) change "T5541" to --T551--.

Col. 10, line 44, Claim 22 — Delete "Aluminum" and substitute --An aluminum--.

Signed and Sealed this

First Day of May 1979

[SEAL]

Attest:

RUTH C. MASON
Attesting Officer

DONALD W. BANNER
Commissioner of Patents and Trademarks